US005531246A

United States Patent [19]

Ritter

[11] Patent Number: 5,531,246

[45] Date of Patent: Jul. 2, 1996

[54] HOSE REEL FOR MOBILE SERVICE VEHICLES

[76] Inventor: Alex F. Ritter, E. 7265 Highview, Coeur d'Alene, Id. 83814

[21] Appl. No.: 329,245

[22] Filed: Oct. 26, 1994

[51] Int. Cl.[6] ..... B65H 75/34

[52] U.S. Cl. ..... 137/355.21; 137/355.16; 60/489

[58] Field of Search ..... 60/489, 487; 137/355.12, 137/355.16, 355.2, 355.21

[56] References Cited

U.S. PATENT DOCUMENTS

| | | | |
|---|---|---|---|
| 2,478,494 | 8/1949 | Martin . | |
| 2,519,064 | 8/1950 | Palm . | |
| 2,595,655 | 5/1952 | Hannay | 137/355.2 |
| 3,150,842 | 9/1964 | Weber | 242/86.5 |
| 3,935,879 | 2/1976 | Miyazaki | 137/355.16 |
| 4,008,791 | 2/1977 | Shafii-Kahany | 137/355.12 |
| 4,148,464 | 4/1979 | Fog et al. | 254/150 |
| 4,473,196 | 9/1984 | Sammann et al. | 242/86.5 R |
| 4,576,337 | 3/1986 | Post et al. | 137/355.2 |
| 5,211,203 | 5/1993 | Vollweiler et al. | 137/355.21 |

FOREIGN PATENT DOCUMENTS

| | | | |
|---|---|---|---|
| 4269 | 2/1914 | United Kingdom . | |
| 449006 | 10/1934 | United Kingdom | 60/489 |

OTHER PUBLICATIONS

American Reeling Devices Inc. brochure, "Reels for Hose and Cable", 1993.

Reelcraft Brochure, "Motor and Manual Driven Hose Reels Series 3000", 1993.

Duro Manufacturing Inc. brochure, "Catalog A–85 Automotive & Industrial", 1993.

Lincoln Catalog, "Catalog 7000—Lubrication Equipment and Accessories", 1993.

Reelcraft Industries, Inc. Brochure, "Portable Lube Rig Reels—Series E8000 & E9000", 1993.

*Primary Examiner*—A. Michael Chambers

*Attorney, Agent, or Firm*—Wells, St. John, Roberts, Gregory & Matkin

[57] ABSTRACT

A powered hose reel is described including a mounting base with a hydraulic motor mounted thereon. The motor is secured to a motor base that, in turn, is releasably secured to the mounting base. The motor further includes a driven rotatable live axle that directly mounts to a hose spool, providing direct driving forces to the spool. The spool includes a drum for receiving a hose, a central spacer disk mounted to the drum, and a center hub. The center hub is fitted to the live axle for coaxial rotation with the live axle such that the spool rotates in direct response to rotation of the motor live axle. A swivel is provided for connection to the inward hose end to allow winding and unwinding of the hose on the spool. Fairleads are provided on the base for guiding hose onto and off from the spool. A control valve may also be provided to selectively lock the motor, allow the motor to freewheel, or to operate to rewind the hose.

21 Claims, 4 Drawing Sheets

HOSE REEL FOR MOBILE SERVICE VEHICLES

TECHNICAL FIELD

The present invention relates to hose reels and more particularly to power driven hose reels for attachment to service vehicles.

BACKGROUND OF THE INVENTION

Service vehicle trucks are often supplied with pumps and fluid supplies for delivering fluids such as air, water, oil, and other various lubricating media to service other large vehicles in the field. It is desirable to provide a substantial length of hose, line, cable, etc. to extend from the service vehicle to the area where servicing is being performed. Many such lines are stored on spools or reels that are driven to rotate to facilitate paying out and taking up the associated line or hose.

The typical reel drive mechanism includes some form of hub on the reel and a shaft that is connected by chain and sprockets, belting, or gear arrangements to a remote drive motor. Such drive assemblies require the use of central bearings for the drive axle and sundry linkage components connected to the drive motors. These are cumbersome, complex and expensive arrangements. Further, it is not at all unusual for the central axle bearings and drive chains/belts, etc. for the spools to wear and give out long before the associated drive motors become worn and require replacement.

Some driven reels are provided with internal "clock" spring return mechanisms. The spring return mechanisms are situated within the reel spool, taking up radial space within the spool. They include the advantage of a cantilever mount configuration wherein the reel spool is mounted at one end of the spring return mechanism, and the mechanism is mounted to the reel frame. Thus, the axle of the spring return becomes the hub of the reel spool. No other bearing mounts, other than internal bearings in the spring return, are used to support the spool. This leaves the outside surface of the reel spool relatively unencumbered. However, spring reels have inherent deficiencies. Spring tension increases as greater length of hose are pulled from the reel spool. This can result in increased pulling effort to strip the hose from the reel and, in uncontrolled circumstances, can also result in the hose being drawn back too quickly by the tightly wound spring. Also, the springs are easily broken by unattended withdrawal and by excessive pulling forces applied to the hose. Further, spring loaded reels will only function with prescribed lengths of hose, given the limited capacity of the spring. Thus different spring mechanisms are required for different hose lengths.

A need has therefore been realized for a hydraulic motor driven reel assembly that is substantially simpler in construction, more durable, and less expensive to operate and maintain. A primary objective of the present invention is therefore to provide a hose reel with a "live axle" drive arrangement, thereby eliminating bearings and drive linkages typically required in previous driven hose reel arrangements. Such provision also fulfills another objective, to provide a durable, safe, easy to operate and maintain hose reel, due to the long wear characteristics of the direct drive hydraulic motor and elimination of complex and easily broken or damaged drive linkages, spring returns, and spring catch mechanisms, and that has unlimited capability for paying out and taking up hose of any length.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

Figure 1:
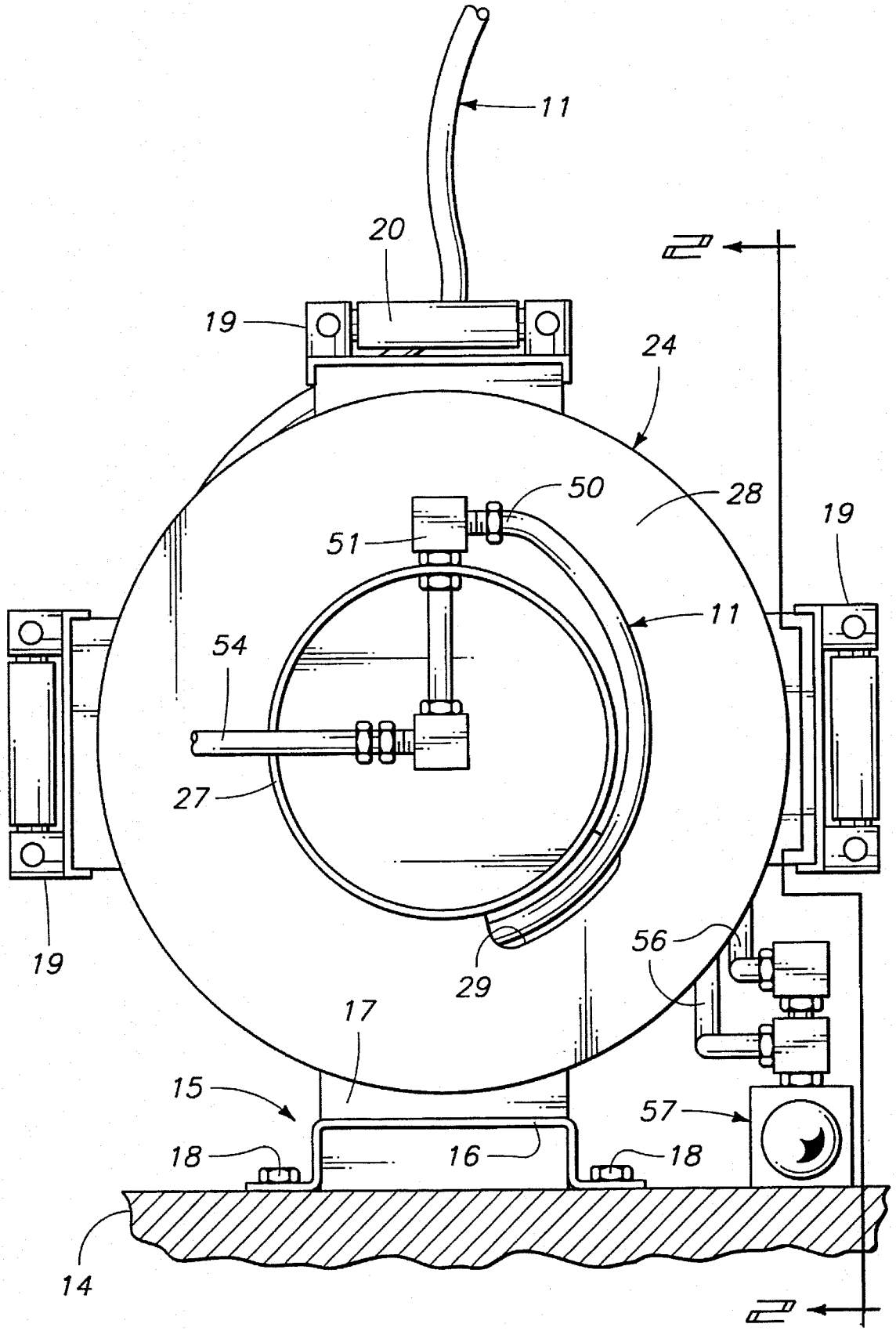
FIG. 1 is a elevation view of a preferred form of the present hose reel.
Figure 3:
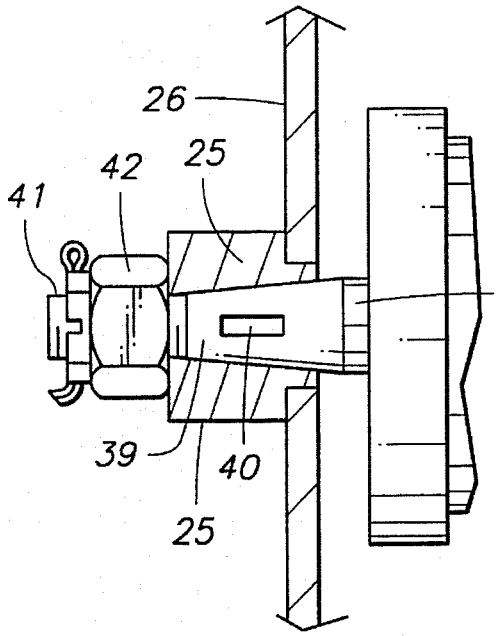
FIG. 3 is an enlarged fragmented view of the live axle and center hub arrangement for the preferred hose reel.

This disclosure of the invention is submitted in furtherance of the constitutional purposes of the U.S. Patent Laws "to promote the progress of science and useful arts" (Article 1, Section 8).

A preferred form of the present hose reel is generally designated in the drawings by the reference numeral 10. The present hose reel 10 is powered for storing, selectively paying out, and taking up an elongated flexible hose 11.

For purposes of this application, the term "hose" should be broadly construed to mean any of a variety of forms of air, water, hydraulic fluid, lubrication media, etc. hose construction. Alternatively, the same reel could be utilized for other types of elongated members such as cable, cord, wire, etc. that is desirable to be paid out and taken up by the present reel configuration. The term "hose" should also be understood to include such other elongated, flexible members, capable of being wound and unwound on a reel.

It is intended that primary use of the present reel configuration be in conjunction with service type vehicles. Thus, the reel 10 is provided with a mounting base 15 that may be secured by means 18 to a vehicle mounting surface 14. The mounting means 18 (FIGS. 1, 2) may be comprised of bolts, screws, rivets, welding or other appropriate securing means suitable for rigidly securing the mounting base to the vehicle.

A preferred form of the mounting base 15 is substantially L-shaped, including a horizontal bracket 16 and an upright bracket section 17. The base 15 is preferably a formed or fabricated shape and is constructed of rigid material such as steel. The horizontal bracket 16 extends outwardly from the upright section 17 which mounts the remaining elements of the reel. The horizontal bracket 16 provides support of the reel components and a stationary surface to which other elements of the assembly can be easily mounted.

Fairleads 19 are mounted to the base 15. Three fairleads 19 are shown in FIG. 1, however, it should be understood that as few as one or even more fairleads may be provided as desired. The fairleads include guide rollers 20 that movably contain the hose 11 in a desired axial relationship to the reel to facilitate taking up and paying out of the hose from the hose storage portion of the reel.

The fairleads 19 may be of relatively conventional construction. The size of the fairleads 19 will vary depending upon the size of hose carried on the reel. They may be constructed with a simple support structure that may be attached by bolts or other conventional fasteners to the reel base.

The rollers 20 may be metal or nonmetallic construction (such as plastic) that are freely rotatable on the fairlead frames by bolts or pins. The fairlead assemblies may be detachable or permanently mounted to the base 15.

The hose reel also includes a rotatable spool 24. The spool is substantially centered about a center hub 25. The hub 25, in turn, is secured to a spacer disk 26 that is affixed to the hollow interior of a drum 27. Axially spaced flanges 28 are affixed to outward surfaces of the drum 27. The flanges 28 and drum 27 define a space on the reel within which the hose is collected, substantially as shown in section by FIG. 2 of the drawings. The size and construction of the spool 24 again depends upon the corresponding size of the hose to be used. The drum diameter is selected to meet the minimum bend radius of the hose to be wrapped.

Components of the spool 24 described above may be individual components affixed by conventional means in the manner shown, or may be integral and formed by spinning, casting or other conventional processes. The spool components should be constructed of a durable, rigid material such as steel. However, other materials may also be used.

It is pointed out that the spacer disk 26 is situated axially within the drum 27 between the flanges 28. This spaced relationship facilitates mounting of the spool 24 in close proximity to the upright section 17 of the base 15. This particular construction facilitates compact construction of the overall reel assembly 10.

It is also noted that a part of the drum projects axially outward of the flanges. This part is used to mount hose connection components that will be described in greater detail below. Further, the outboard flange is provided with a slot 29 (FIGS. 1, 6) to permit the hose 11 to be tangentially threaded from the connection components onto the drum 27.

The spool 24 is mounted to the base 15 by way of a drive motor 35. Thus, the spool is both mounted to the base 15 and driven by the drive motor 35, thereby eliminating intermediate bearing and drive linkage assemblies that have typically been found in other powered reel assemblies.

In the preferred example shown, the drive motor 35 is a hydraulic motor having a mounting base 36 that is rigidly attached to the base 15 by attachment bolt and nut assemblies 37 or equivalent forms of releasable fasteners.

It is significant to note that the motor is mounted at one of its ends by the mounting base 36 to the reel base 15. Thus the entire length of the motor 35 is cantilevered from the base 15 and supports the spool 24 at its remaining end. The weight of the spool is thus borne through the motor drive shaft and rotates by provision of the motor bearings. The described mounting arrangement provides several advantages. Firstly, the rear mounted motor functioning both as driver and bearing significantly simplifies the construction of the reel 10 by eliminating any need for intermediate drive connections such as sprockets, chains, mounting bearings. Secondly, the axial length of the rear mounted motor, being substantially confined within the drum 27, minimizes the overall axial dimension of the reel 10. Thirdly, the cantilevered mount for the motor allows the internal bearings of the motor to accept and rotatably support the spool 24 and hose 11 to the base 15. It has been found that the conventional internal bearings of the hydraulic motor 35 are more than adequate to support the load. Fourthly, the rear mount for the motor allows easy access to the hydraulic fittings on the motor and adequate internal clearance between the motor, fittings, hydraulic lines, and the spool drum 27. Still further, the end mounted base 36, being flush against the reel base 15, enables the spool to be designed such that the inside flange 28 of the spool can be situated in close proximity to the reel base. This enables a variety of reel designs, with various axial drum hose lengths.

The above mounting arrangement is made possible by use of the mounting base 36. The motor base 36 is rigidly secured to the motor 35 by bolts 34. Heads of the bolts 34 are received within countersinks 33 formed in the back side of the motor base 36. The back side of the base will thus fit flush and secure against the upright section 17 of the reel base 15.

While it is possible that the motor could be mounted securely to the reel base, using the bolts 34 and appropriate holes (not shown) through the reel base section 17, it is preferred that the motor base 36 be used. The motor base 36 adds rigidity to the upright section 17 of the reel base in the location of the motor 35. This arrangement also facilitates ease in removal of the motor 35 from the reel base 15 simply by removing the attachment nuts of the bolt and nut assemblies 37. The motor 35 and motor base 36 are thus removable as a unit.

The motor 35 includes a central live axle 38 which is also the drive shaft of the motor 35, providing rotational driving forces to the attached spool 24. The preferred motor 35 is of a conventional hydraulic variety such as a "gerotor," "geroler" "disk valve," "vane" or "piston" motor design. Such conventional motors typically include internal bearing assemblies that facilitate rotation of the drive shaft or live axle 38 about a fixed rotational axis. Thus, the bearings for the motor become the rotational bearings for the spool.

In one preferred example the drive motor 35 is a "Eaton" brand hydraulic motor Model No. 101-2256 produced by Eaton Corp. of 15151 Hwy. 5, Eden Prairie, Minn. 55344.

The center hub 25 of spool 24 is fitted to the live axle 38 for direct coaxial rotation with the live axle such that the spool will rotate in direct response to operation of the motor 35. To this end, the live axle 38 is advantageously provided with an end tapered section 39. The center hub 25 is provided with a similarly tapered bore. These interfit in such a manner to secure the spool 24 to the axle 38 in a centered relation. A key 40 is provided in a preferred form between the tapered axle section 39 and center hub 25 to assure direct drive connection between the motor and spool. It is noted that optional shafts may also be used such as straight/keyed or splined shafts with appropriate mating configurations on the center hub.

In the preferred form, the outward end of the axle 38 is threaded at 41 to receive a nut 42. The nut 42 can be selectively secured to firmly secure and center the spool on the live axle 38. In a preferred form, the nut 42 is a locking "castellated" nut locked by a cotter pin to retain the spool on the axle. The nut may be selectively removed to facilitate removal of the spool from the axle 38 and motor 35 to facilitate mounting of the unit to a service vehicle, or to facilitate maintenance and repair of the spool and/or motor.

Figure 2:
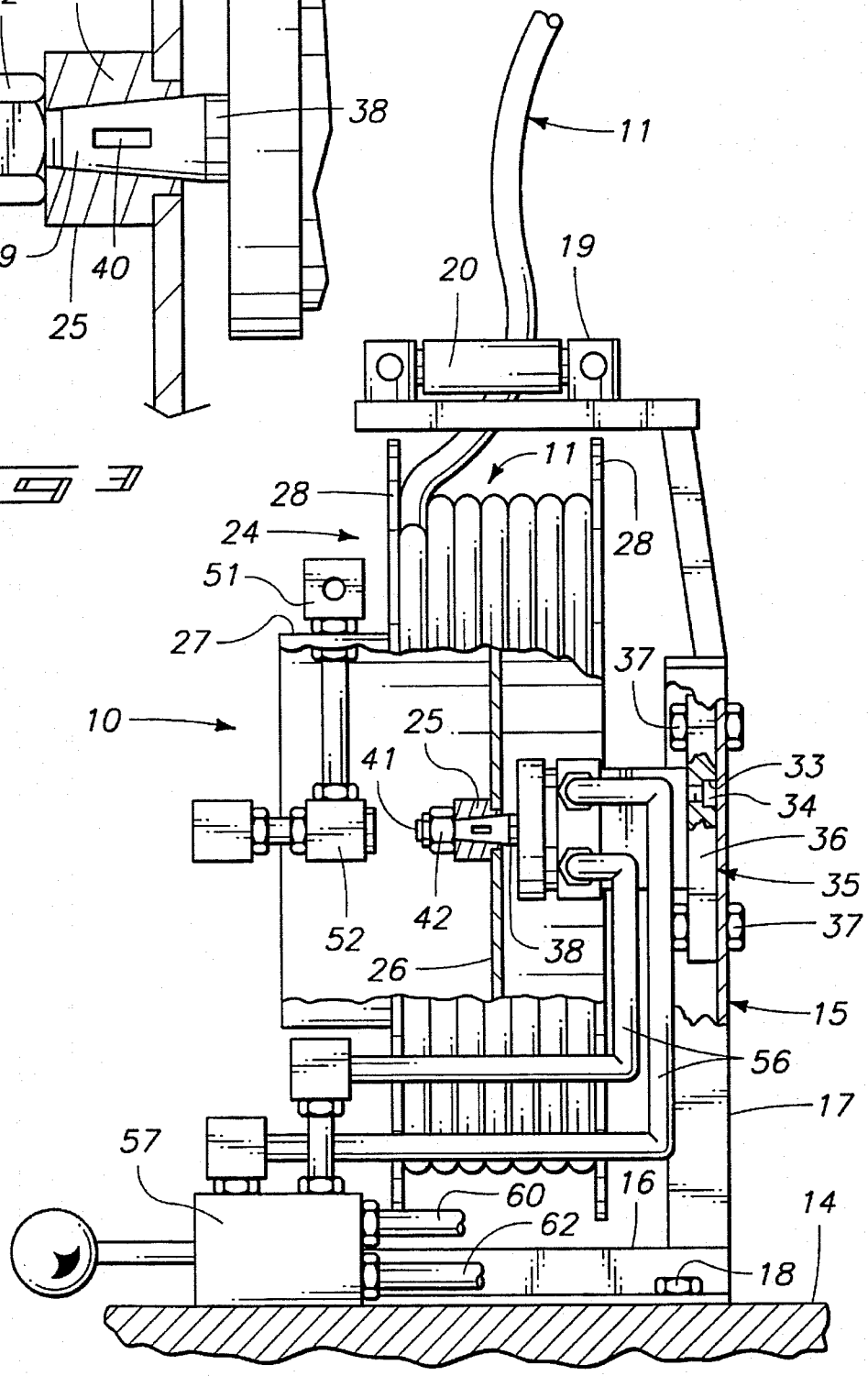
FIG. 2 is a sectional view taken substantially along line 2—2 in FIG. 1.
Figure 6:
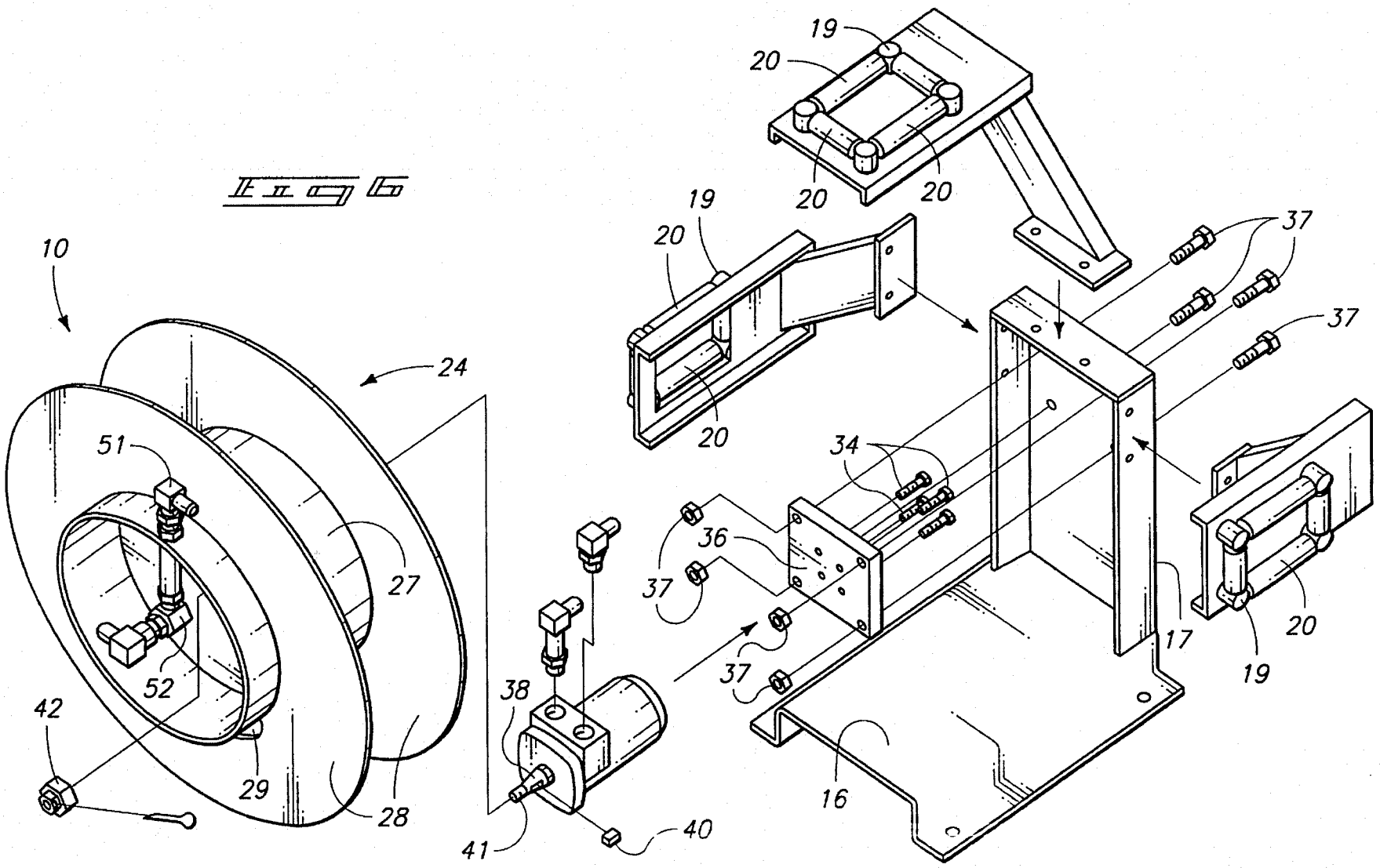
FIG. 6 is an exploded perspective view of the preferred form of the present invention.

Provision is made on the spool 24 for mounting the inward hose end 50 for rotation with the spool and for connection to a supply source by means of a swivel arrangement. A fitting 51 is provided for this purpose on the hub portion extending outwardly of the flanges. The fitting 51 mounts the hose end 50 and extends by rigid pipe fittings and couplings to a fluid passage swivel 52 (FIGS. 2, 6).

The swivel 52 is centered on the rotational axis of the spool 24. The fluid passage swivel 52 is a conventional swivel fitting that will facilitate a stationary fitting on one side and a rotational fitting on the other while permitting leak free passage of fluid through the swivel body. This is a conventional form of fitting common in the hydraulic and pneumatic arts. Standard tube connections extend from the swivel to a source of fluid to be delivered through the hose 11.

Where electrical cable is to be used as the "hose," the swivel may be provided as a conventional slip ring to conduct electrical energy to the "hose" while permitting relatively free rotation of the spool.

A lead 54 (FIG. 1) extends to a source of supply for the hose reel. The lead 54 does not comprise part of the present invention, nor does the supply source for the hose. Additionally, it should be noted that the hose reel 10 may be produced and sold with or without a prescribed length of hose 11 supplied on the reel. The hose may be supplied by the purchaser, or may be installed during manufacture according to the needs of the consumer.

Figure 4:
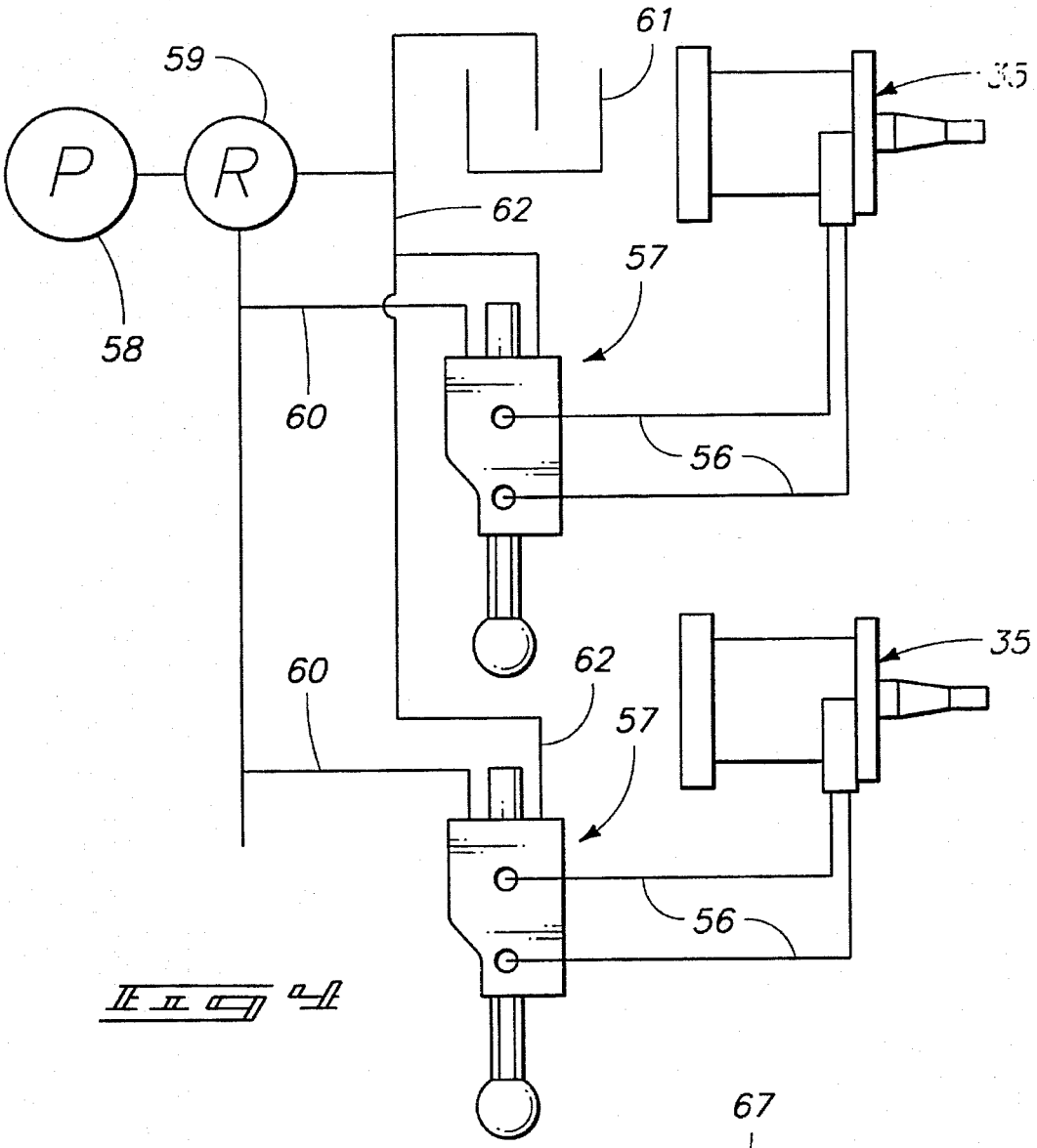
FIG. 4 is a schematic showing parallel connection for multiple hose reels to a single drive source.
Figure 5:
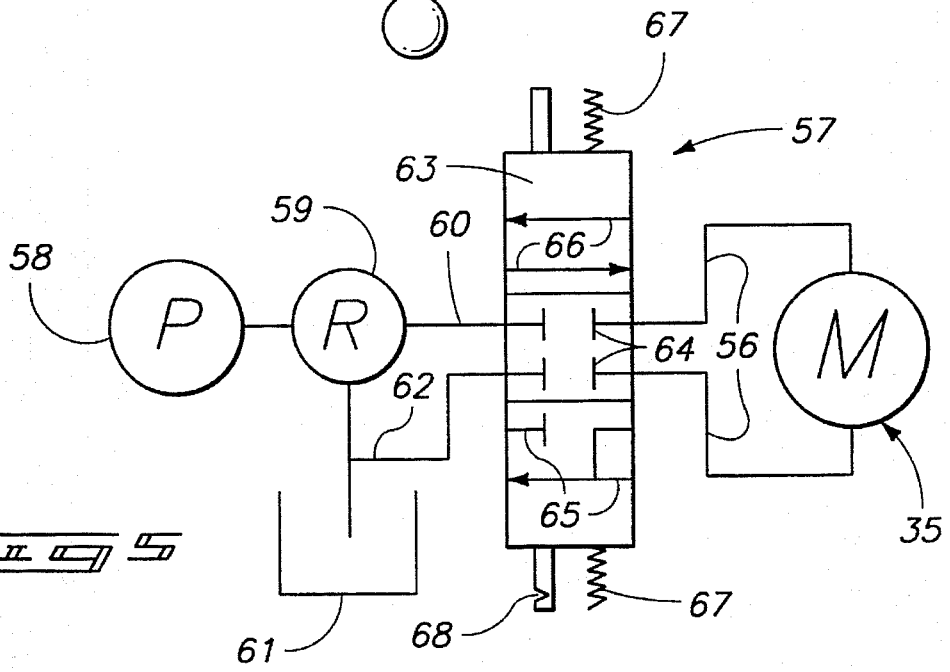
FIG. 5 is a schematic view of a preferred valve or control valve arrangement for the present hose reel.

FIGS. 4 and 5 show in schematic form, a drive circuit and control means for the motor 35. Control is selective through provision of a preferred control valve 57 that permits operation of the motor in one of several selected modes. These different operational modes are effected by selectively positioning a control valve spool 63 shown in schematic form in FIG. 5.

Hydraulic lines run from a pressure source such as a pump 58 through a conventional pressure relief valve 59, through a pressure line 60, and back through a return line 62 by way of a common reservoir 61. The relief valve 59 is selected to divert fluid flow to the reservoir upon a build up of excessive operational pressure in the pressure line 62. By way of example, excessive pressure may be that which could be experienced when an undesired amount of tension is applied to the hose, as when the hose is caught up or entangled. The valve thus acts as a safety device, stalling operation of the motor when such excessive pressure build up is experienced.

Pressurized fluid is applied through the valve 57 and is directed by passages in the spool to effect operation of the motor 35. In a preferred form, the valve 57 is normally set in a "stop" position, with the pressure and return lines blocked. This effectively locks the motor 35 and prevents undesired rotation of the spool 24. Numeral 64 identifies the lock or stop passages through the valve 57. Since no fluid is permitted to flow to or from the motor, the relief valve 59 will function to divert the pressurized fluid to the reservoir 61.

The valve 57 also includes "unwind" passages 65 which may be selected by pulling the spool outwardly. When the passages 65 are aligned with the pressure and return lines, only return fluid is allowed to flow. The pressure line 60 is effectively blocked. In this condition, the motor will turn responsive to rotation of the spool, as when hose is being pulled away. Thus the motor is in a substantially "neutral" condition to facilitate selective removal or paying out of the hose without the spool being under power.

A releasable automatic detent 68 is provided on the valve to selectively hold the valve in the neutral position, thereby allowing the operator to pull a desired length of hose from the reel without further operation of the valve. The releasable automatic detent may be any of several known mechanisms, such as the common spring biased ball and socket form.

The valve operator may be pushed inwardly to shift the valve spool to align the "rewind" passages 66 with the pressure and return lines. The passages 66 thus open a normal operating circuit to the motor 35, causing the motor to operate, turning the live axle 38 and hose spool 24. The rotating spool thus functions to take up the hose onto the drum 27. The fairleads 19 function at this time to direct the hose length onto the spool between the flanges 28.

Springs 67 are provided in the valve 57 to automatically return the valve spool 63 to the "lock" position when the operator is released. This is a safety measure, assuring that the valve will not be inadvertently left in the retrieval mode.

FIG. 4 is included to show that several of the present hose reels 10 may be connected in a parallel hydraulic circuit, to be operated from a single source of hydraulic pressure. As many reels 10 can be connected in this manner as permitted by the capacity of the hydraulic pressure source.

Installation of the present hose reel 10 is a simple matter of connecting the base 16 to an appropriate surface 14 of the service vehicle. This is accomplished simply by using the appropriate mounting means 18. If bolts are used as the mounting means, the installer may simply bore appropriate holes in the mounting surface 14 in alignment with the mounting bolts, and attach the base by securing the bolts through the drilled holes. For other types of mounting means, other appropriate measures are taken.

Next, the control valve 57 is attached using known hydraulic connectors to a typically provided pump on the service vehicle. The present reel 10 is now ready for use.

Assuming no hose is provided on the reel, one may be attached simply by threading the inward end 50 through a selected fairlead 19, and through the provided opening 29 in the outward flange 28. The end 50 is then attached to the fitting 51 on the drum 27. The length of hose is then reeled onto the drum by pushing the operator of the control valve to shift the "rewind" passages 66 into alignment in the hydraulic circuit. The motor is thus energized and will rotate the spool to take up the desired length of hose 11.

Once the desired length has been accumulated on the drum 27, the operator simply releases the valve operator, allowing the springs 67 to return the "lock" passages 64 of the valve spool into alignment with the pressure and return lines 62, 60. The motor will then stop and lock itself and the spool against further rotation.

When it is desired to pay hose out from the spool, the operator simply pulls the valve operator to shift the valve spool to bring the "unwind" passages 65 into alignment with the pressure and return lines 60, 62. The motor 35 is now in a neutral mode and can be turned relatively freely by pulling hose from the spool 24. The detent 68 operates to hold the valve in this position until the operator manually pushes the operator inwardly. The detent is then disengaged and the valve automatically returns to the "lock" mode (unless the user continues to push the operator to shift the valve to the "rewind" mode).

During all of the above operations the motor's live axle and internal bearings support the spool and permit rotation directly without intermediate drive linkages. The internal bearings of the motor 35 provide the dual functions of journalling the axle 38 and the spool, thereby eliminating the need for separate bearings for the spool. Further, it has been found that the motor bearings, due to their sealed and heavy duty construction, will perform longer and at least as efficiently as other bearing types, for the life of the motor.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A powered hose reel, comprising:

a mounting base;

a motor releasably secured to the base in a cantilevered manner, with one axial end thereof secured to the mounting base and including a driven rotatable live axle projecting from a remaining opposite axial end;

a spool including a drum for receiving a hose, a central spacer disk mounted to the drum, and a center hub; and wherein the center hub is fitted to the live axle such that the spool is cantilevered on the live axle and motor for coaxial rotation with the live axle in direct response to rotation of the motor live axle.

2. The powered hose reel as claimed by claim 1 wherein the live axle includes a tapered section and wherein the center hub includes a mating tapered bore for receiving the tapered section of the live axle.

3. The powered hose reel as claimed by claim 1 further comprising a central hose swivel mounted to the spool coaxial with the center hub and independent of the live axle.

4. The powered hose reel as claimed by claim 1 further comprising a hose fairlead mounted to the base and positioned thereon adjacent the spool to receive and guide hose from the spool.

5. The powered hose reel as claimed by claim 1 wherein the motor is a hydraulic motor, and further comprising:

a control valve operatively connected to the motor and including neutral, stop, and rewind settings for operating the motor to respectively facilitate free wheeling of the spool, locking of the spool, and rewind rotation of the spool.

6. The powered hose reel as claimed by claim 1 wherein the motor is a hydraulic motor, and further comprising:

a control valve operatively connected to the motor and including neutral, stop, and rewind settings for operating the motor to respectively facilitate free wheeling of the spool, locking of the spool, and rewind rotation of the spool; and a detent for selectively holding the control valve in the neutral setting.

7. The powered hose reel as claimed by claim 1 wherein the motor is a hydraulic motor, and further comprising:

a control valve operatively connected to the motor and including neutral, stop, and rewind settings for operating the motor to respectively facilitate free wheeling of the spool, locking of the spool, and rewind rotation of the spool; and a spring urging the control valve to the stop position.

8. The powered hose reel as claimed by claim 1 wherein the motor is a hydraulic motor, and further comprising:

a control valve operatively connected to the motor and including neutral, stop, and rewind settings for operating the motor to respectively facilitate free wheeling of the spool, locking of the spool, and rewind rotation of the spool;

wherein the control valve includes a spring urging the control valve to the stop position; and wherein the control valve further includes a detent for selectively holding the control valve in the neutral setting.

9. The powered hose reel as claimed by claim 1 wherein the motor is a hydraulic motor, and further comprising a relief valve connected to the motor.

10. The powered hose reel as claimed by claim 1 wherein the live axle includes a tapered section and wherein the center hub includes a mating tapered bore for receiving the tapered section of the live axle; and a central hose swivel mounted to the spool coaxial with the center hub and live axle.

11. The powered hose reel as claimed by claim 1 wherein the live axle includes a tapered section and wherein the center hub includes a mating tapered bore for receiving the tapered section of the live axle;

a central hose swivel mounted to the spool coaxial with the center hub and live axle; and a hose fairlead mounted to the base and positioned thereon adjacent the spool to receive and guide hose from the spool.

12. The powered hose reel as claimed by claim 1 wherein the live axle includes a tapered section and wherein the center hub includes a mating tapered bore for receiving the tapered section of the live axle;

a central hose swivel mounted to the spool coaxial with the center hub and live axle;

a hose fairlead mounted to the base and positioned thereon adjacent the spool to receive and guide hose from the spool;

wherein the motor is a hydraulic motor, and further comprising:

a control valve operatively connected to the motor and including neutral, stop, and rewind settings for operating the motor to respectively facilitate free wheeling of the spool, locking of the spool, and rewind rotation of the spool.

13. The powered hose reel as claimed by claim 1 wherein the live axle includes a tapered section and wherein the center hub includes a mating tapered bore for receiving the tapered section of the live axle;

a central hose swivel mounted to the spool coaxial with the center hub and live axle;

a hose fairlead mounted to the base and positioned thereon adjacent the spool to receive and guide hose from the spool;

wherein the motor is a hydraulic motor, and further comprising:

a control valve operatively connected to the motor and including neutral, stop, and rewind settings for operating the motor to respectively facilitate free wheeling of the spool, locking of the spool, and rewind rotation of the spool; and a detent for selectively holding the control valve in the neutral setting.

14. The powered hose reel as claimed by claim 1 wherein the live axle includes a tapered section and wherein the center hub includes a mating tapered bore for receiving the tapered section of the live axle;

a central hose swivel mounted to the spool coaxial with the center hub and live axle;

a hose fairlead mounted to the base and positioned thereon adjacent the spool to receive and guide hose from the spool;

wherein the motor is a hydraulic motor, and further comprising:

a control valve operatively connected to the motor and including neutral, stop, and rewind settings for operating the motor to respectively facilitate free wheeling of the spool, locking of the spool, and rewind rotation of the spool;

a detent for selectively holding the control valve in the neutral setting; and a spring urging the control valve to the stop position.

15. The powered hose reel as claimed by claim 1 further comprising a motor base secured to the motor at the one axial end and releasably mounted to the base.

16. A powered hose real for service vehicles having a mounting surface, comprising:

a mounting base;

means on the mounting base for securing the mounting base to the mounting surface on the service vehicle;

a hydraulic motor having a central rotatable live axle; the hydraulic motor further including a motor base at an end thereof opposite the live axle;

attachment means for releasably securing the motor base to the mounting base with the live axle substantially perpendicular to the mounting base and extending to one side thereof;

a spool including a substantially cylindrical drum for receiving a length of flexible hose, a central spacer disk affixed to the drum, a center hub affixed to the central spacer disk, and axially spaced flanges on the drum extending radially therefrom outward of the central spacer disk;

wherein the central spacer disk is located axially along the spool between the flanges; and wherein the center hub is fitted to the live axle for coaxial rotation with the live axle such that the spool rotates in direct response to rotation of the motor live axle.

17. The powered hose reel as claimed by claim 16 wherein the live axle includes a tapered section and wherein the center hub includes a mating tapered bore for receiving the tapered section of the live axle.

18. The powered hose reel as claimed by claim 16 further comprising a central hose swivel mounted to the spool coaxial with the center hub and live axle.

19. The powered hose reel as claimed by claim 16 further comprising a hose fairlead mounted to the base and positioned thereon adjacent the spool to receive and guide hose from the spool.

20. The powered hose reel as claimed by claim 16 wherein the motor is a hydraulic motor, and further comprising:

a control valve operatively connected to the motor and including neutral, stop, and rewind settings for operating the motor to respectively facilitate free wheeling of the spool, locking of the spool, and rewind rotation of the spool.

21. The powered hose reel as claimed by claim 16 wherein the motor is a hydraulic motor, and further comprising:

a control valve operatively connected to the motor and including neutral, stop, and rewind settings for operating the motor to respectively facilitate free wheeling of the spool, locking of the spool, and rewind rotation of the spool;

a detent for selectively holding the control valve in the neutral setting; and a spring urging the control valve to the stop position.

* * * * *